US007011499B2

(12) United States Patent
Tomlin et al.

(10) Patent No.: US 7,011,499 B2
(45) Date of Patent: Mar. 14, 2006

(54) FAN BLADE COVER WITH ORNAMENT

(75) Inventors: Christina B. Tomlin, 121 Tregarone Rd., Timonium, MD (US) 21093; Pamela S. Tomlin, Ponte Vedra Beach, FL (US)

(73) Assignee: Christina B. Tomlin, Lutherville, MD (US)

( * ) Notice: Subject to any disclaimer, the term of this patent is extended or adjusted under 35 U.S.C. 154(b) by 3 days.

(21) Appl. No.: 10/755,994

(22) Filed: Jan. 13, 2004

(65) Prior Publication Data

US 2005/0152783 A1 Jul. 14, 2005

(51) Int. Cl.
*B63H 7/00* (2006.01)

(52) U.S. Cl. ..... 416/62; 150/154; D23/411

(58) Field of Classification Search ..... 416/5, 416/62, 146 R; 150/158, 165, 154; D23/411; 446/227

See application file for complete search history.

(56) References Cited

U.S. PATENT DOCUMENTS 4,676,721 A * 6/1987 Hardee ..... 416/146 R
4,832,572 A 5/1989 Prucha et al.
4,904,220 A * 2/1990 Williams et al. ..... 446/227
5,110,261 A * 5/1992 Junkin ..... 416/5
5,281,093 A 1/1994 Sedlak et al.
5,516,264 A * 5/1996 Anetrini ..... 416/62
5,564,900 A 10/1996 McAuley
5,591,005 A 1/1997 McCready
5,591,006 A 1/1997 DeMeo et al.
5,947,686 A 9/1999 Keyes
6,015,261 A 1/2000 Barone
6,019,479 A 2/2000 Barker
6,464,594 B1 * 10/2002 Canna et al. ..... 446/227
D478,380 S * 8/2003 Clymer ..... D23/377
6,619,920 B1 9/2003 Cannon

* cited by examiner

*Primary Examiner*—Edward K. Look
*Assistant Examiner*—Igor Kershteyn
(74) *Attorney, Agent, or Firm*—McAndrews, Held & Malloy, Ltd.

(57) ABSTRACT

A cover for a fan blade. The cover includes a sleeve having an open end for receiving the fan blade. The sleeve has hook and loop fasteners that are configured to engage each other to secure the sleeve about the fan blade. The cover also includes an ornament and connection features extending from the sleeve and the ornament. The connection features engage each other to connect the ornament to the sleeve such that, as the fan blade rotates, the sleeve and ornament rotate therewith.

18 Claims, 2 Drawing Sheets

FAN BLADE COVER WITH ORNAMENT

BACKGROUND OF THE INVENTION

The present invention relates to a decorated cover for a fan blade. More particularly, certain embodiments of the present invention relate to a fan blade cover configured to carry an ornament.

Infants and small children spend a considerable amount of time lying on their backs in a crib staring up at the ceiling. Often the monotony of this vantage point drives the child to express his or her displeasure by an outburst of tears and wails. Therefore, parents often will hang a mobile over the child's crib. The conventional mobile includes several differently shaped and colored ornaments or toys, often sharing a theme or pattern, connected together by a system of threads or strings. The mobile is hung from the ceiling or some other overhead object, or extends from the crib itself, above the child in order that the child can see the different ornaments. Additionally, mobiles often may be manipulated or wound-up and released in order that the ornaments move around relative to each other or the entire mobile rotates or moves up and down above the crib. The shapes, colors, patterns, and movements of the ornaments distract and entertain the child and thus may reduce the number of the child's outbursts. Often the ornaments are shaped like numbers, alphabet letters, or animals in order that the mobile not only distract the child, but also have educational value. Furthermore, observing moving ornaments having certain contrasting colors and patterns may help improve the child's focus and thus better prepare the child for learning activities.

The conventional mobile suffers from some drawbacks however. The movement of the mobile and its ornaments plays an important part in distracting and entertaining the child. However, the wind-up mobile eventually stops moving after a certain amount of time, and when the mobile stops moving, the child may become upset. Additionally, the conventional mobile has only the ornaments that are attached thereto or that are sold therewith. Therefore, if a parent wishes to change the types of ornaments above the child, the parent needs to buy an entirely new mobile with different shaped, colored, and themed ornaments. Similarly, a parent cannot interchange different ornaments on a conventional mobile to create an individually tailored mobile for the child displaying a desired variety of colors, patterns, or themes. Additionally, mobiles are often suspended only a short distance above the crib, and thus the child may be able to reach up and disrupt or break the mobile and its ornaments.

Therefore, a need exists for a mobile system that overcomes the deficiencies of conventional mobiles.

BRIEF SUMMARY OF THE INVENTION

Certain embodiments of the present invention include a cover for a fan blade. The cover includes a sleeve having an open end for receiving the fan blade. The sleeve has hook and loop fasteners that are configured to engage each other to secure the sleeve about the fan blade. The cover also includes an ornament and connection features extending from the sleeve and the ornament. The connection features engage each other to connect the ornament to the sleeve such that, as the fan blade rotates, the sleeve and ornament rotate therewith.

Certain embodiments of the present invention include a decorative mobile for use with an overhead fan blade. The mobile includes a cover having closed rear and side ends to form a passageway at an open end opposite the rear end. The open end receives the fan blade into the passageway. The cover has hook and loop fasteners that are configured to engage each other to secure the cover about the fan blade. The cover has a first connection feature extending therefrom. The mobile also includes an ornament having a second connection feature extending therefrom. The first and second connection features engage each other to connect the ornament to the cover such that, as the fan blade rotates, the cover and ornament rotate therewith.

Certain embodiments of the present invention include a decorative mobile for use with an overhead fan blade. The mobile includes a cover having closed rear and side ends to form a passageway at an open end opposite the rear end. The open end receives the fan blade into the passageway. The cover has hook and loop fasteners that are disposed proximate each other on a top side of the cover. The cover is folded about the top side such that one of the hook and loop fasteners is folded over, and engages, the other of the hook and loop fasteners to secure the cover to the fan blade. The cover has a first connection feature extending therefrom. The mobile also includes an ornament. The ornament has a second connection feature extending therefrom. The first and second connection features engage each other to connect the ornament to the cover such that, as the fan blade rotates, the cover and ornament rotate therewith.

Figure 1:
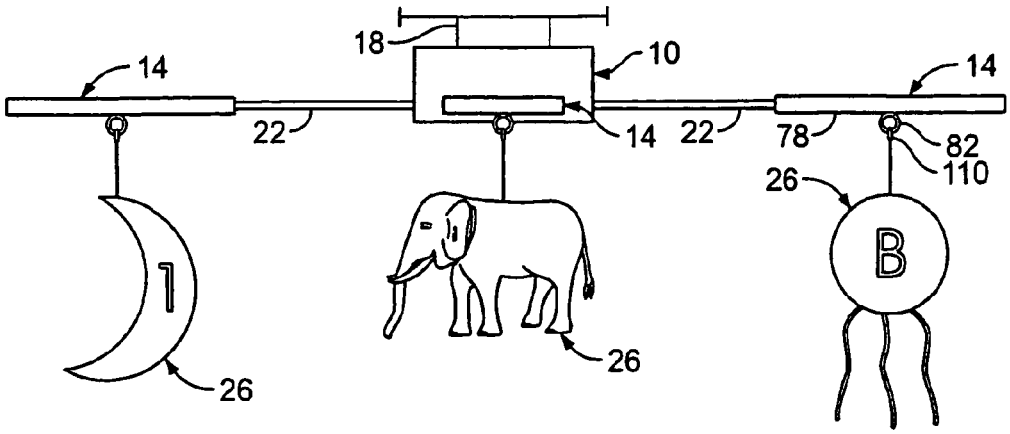
FIG. 1 illustrates a side view of an overhead fan and blade covers according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a side view of an overhead fan or ceiling fan 10 and blade covers 14 according to an embodiment of the present invention. The fan 10 has an electric motor 18 and fan blades 22. The blade covers 14 receive, and are secured to, the fan blades 22. The fan blade covers 14 include ornaments 26 that are suspended therefrom. When the fan 10 is activated, the motor 18 causes the fan blades 22 to rotate thereabout. The blade covers 14 stay secured to the fan blades 22 and thus the blade covers 14 and ornaments 26 rotate with the fan blades 22. The blade covers 14 may have any number of different colors and patterns. Additionally, the ornaments may have any number of different shapes, colors, and patterns. Thus, the rotating blade covers 14 and ornaments 26 may be used to create any number of different visual displays.

Figure 2:
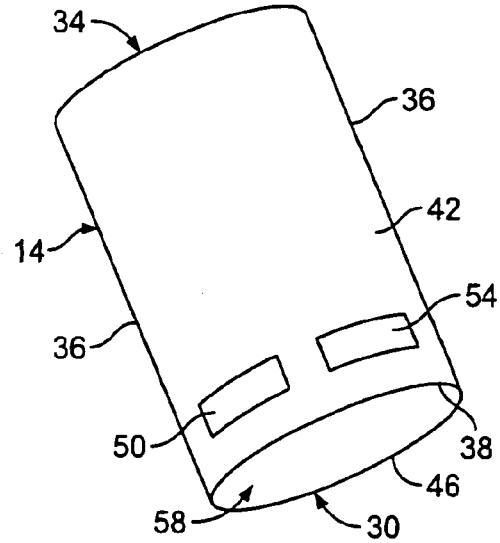
FIG. 2 illustrates a top isometric view of a blade cover of FIG. 1.

FIG. 2 illustrates a top isometric view of a blade cover 14 of FIG. 1. The blade cover 14 is a sleeve made from a durable washable material and may have a variety of colors, patterns, and styles. For example, the blade cover 14 may be made of fabrics such as cotton, nylon, or any other synthetic material or any blend of materials. The material of the blade cover 14 is sewn to form a generally rectangular shape and resembles an elongated sleeve with an open end 30, a closed end 34, and side ends 36. The closed end 34 and the side ends 36 of the blade cover 14 are secured by stitching while edges 38 along the open end 30 are stitched to prevent fraying. Alternatively, any other method known in the art besides sewing or stitching may be used to form the material into the blade cover 14. The open end 30 leads to a passageway 58 within the blade cover 14. The blade cover 14 has top side 42 and a bottom side 46. The blade cover 14 has hook and loop fasteners 50 and 54 such as those sold under the trademark VELCRO on the top side 42 proximate the closed end 34. Alternatively, any number of other types of hook and loop fasteners 50 and 54 may be used. The hook and loop fasteners 50 and 54 may be sewn into the top side 42 of the blade cover 14 or attached to the blade cover 14 by some other means. By way of example only, the hook and loop fasteners 50 and 54 may be glued to the top side 42.

Figure 3:
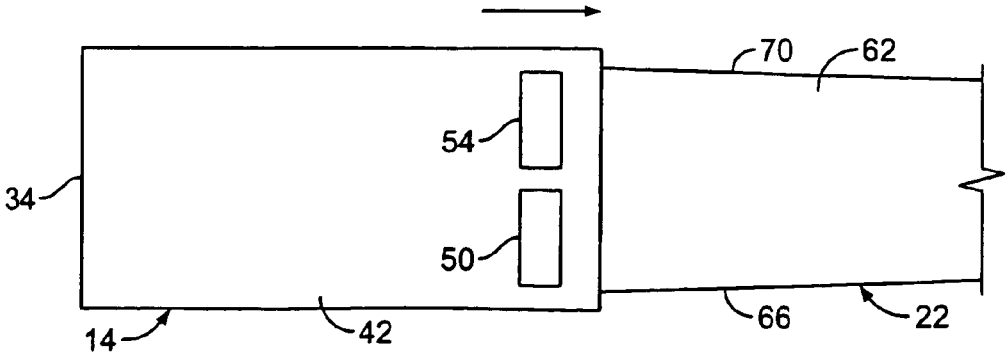
FIG. 3 illustrates a top view of the blade cover of FIG. 2 receiving a fan blade according to an embodiment of the present invention.

FIG. 3 illustrates a top view of the blade cover 14 of FIG. 2 receiving a fan blade 22 according to an embodiment of the present invention. In operation, the blade cover 14 is positioned on the fan blade 22 by sliding the blade cover 14 in the direction of arrow A about the fan blade 22 such that the fan blade 22 is received in the passageway 58 (FIG. 2) of the blade cover 14. The fan blade 22 is fully inserted into the blade cover 14 when the fan blade 22 engages the closed end 34 of the blade cover 14. The blade cover 14 is positioned on the fan blade 22 such that the top side 42 and the hook and loop fasteners 50 and 54 of the blade cover 14 are on a top side 62 of the fan blade 22. Because the blade cover 14 is wider than the fan blade 22, the blade cover 14 has excess material extending along first and second sides 66 and 70 of the fan blade 22.

Figure 4:
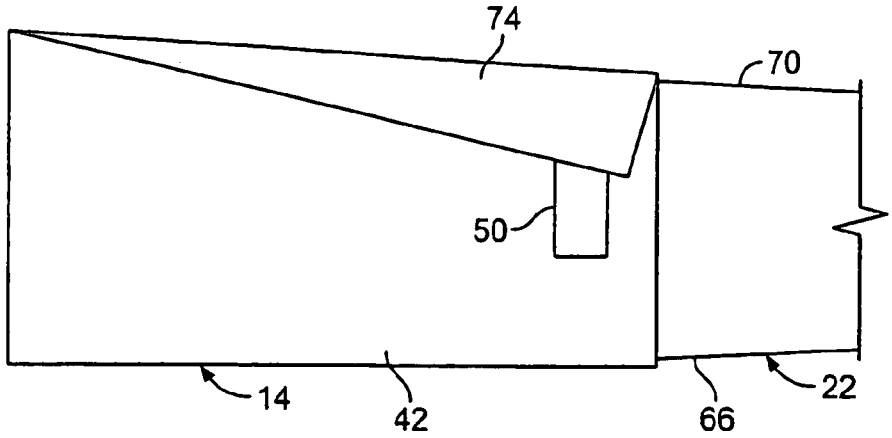
FIG. 4 illustrates a top view of a blade cover and a fan blade according to an embodiment of the present invention.

FIG. 4 illustrates a top view of the blade cover 14 and the fan blade 22 formed according to an embodiment of the present invention. When the fan blade 22 is fully inserted into the blade cover 14, the excess material of the blade cover 14 is pulled tight against the first side 66 of the fan blade 22. Then the excess material on the second side 70 of the fan blade 22 is folded tightly over the top side 42 of the blade cover 14 such that a triangular fold 74 is formed along the top side 42. The fold 74 is folded over the top side 42 such that one of the hook and loop fasteners 50 and 54 (not shown) on the underside of the fold 74 engages the other of the hook and loop fasteners 50 and 54 remaining on the unfolded portion of the top side 42.

Figure 5:
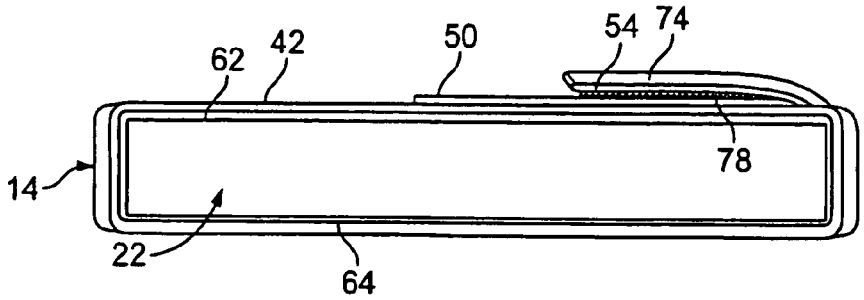
FIG. 5 illustrates a side view of the blade cover and the fan blade of FIG. 4.

FIG. 5 illustrates a side view of the blade cover 14 and the fan blade 22 of FIG. 4. As shown, the fold 74 includes one of the hook and loop fasteners 50 and 54 along an underside portion 78 thereof. When the fold 74 is folded tightly over the top side 42 of the blade cover 14, one of the hook and loop fasteners 50 and 54 on the underside portion 78 engages the other of the hook and loop fasteners 50 and 54 on the unfolded portion of the top side 42 of the blade cover 14. The engaged hook and loop fasteners 50 and 54 maintain the blade cover 14 tightly folded about the fan blade 22 in order that the blade cover 14 does not slide off of, or become disengaged from, the fan blade 22 when the fan blade 22 rotates. Alternatively, the blade cover 14 may be positioned on, and connected to, the fan blade 22 such that the top side 42 of the blade cover 14 extends along a bottom side 64 of the fan blade 22. The blade cover 14 may be folded to engage the hook and loop fasteners 50 and 54 such that the blade cover 14 is tightly secured about fan blades having either a tapered shape or a uniform width.

Alternatively, any number of other methods may be used to connect the blade cover 14 to the fan blade 22. For example, at least one of the hook and loop fasteners 50 and 54 may be connected, for example by gluing, to the top side 62 of the fan blade 22 while the other of the hook and loop fasteners 50 and 54 may be connected to the interior of the top side 42 of the blade cover 14. Thus, when the blade cover 14 is slid over the fan blade 22, the hook and loop fasteners 50 and 54 engage each other to maintain the blade cover 14 about the fan blade 22. Alternatively, any number of other methods known in the art may be used to connect the blade cover 14 to the fan blade 22. Examples of such methods are disclosed in U.S. Pat. Nos. 6,019,479, 5,591,005, 6,015,261, 5,516,264, 5,591,006, 5,281,093, 6,619,920, 5,947,686, and 5,564,900.

Figure 6:
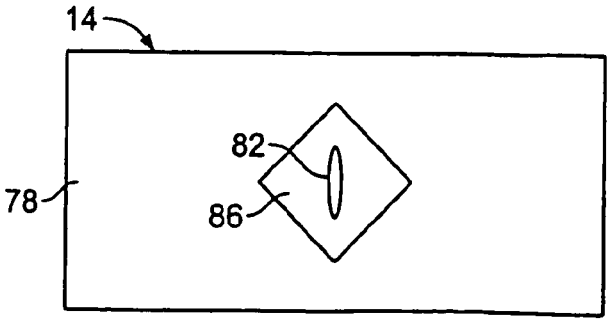
FIG. 6 illustrates a bottom view of the blade cover of FIG. 2.

FIG. 6 illustrates a bottom view of the blade cover 14 of FIG. 2. The blade cover 14 has a bottom side 78 that covers the bottom side 64 (FIG. 5) of a fan blade 22 (FIG. 5) when the blade cover 14 is on the fan blade 22. The bottom side 78 includes a patch 86 sewn or stitched thereto. The patch 86 may be made of the same material as the blade cover 14 and may have any number of different shapes, patterns, colors, or designs. Alternatively, the patch 86 may be connected to the bottom side 78 by any number of other means, for example, by glue. The bottom side 78 includes a ring 82 sewn or stitched into the patch 86 and/or the bottom side 78. Alternatively, the bottom side 78 may not have a patch 86 and the ring 82 may be sewn directly to the bottom side 78. Alternatively, the ring 82 may be a hook, clasp, clip, prong, fastener or any other number of other connecting features. Alternatively, the ring 82 may be connected to the bottom side 78 by any number of other means. When the blade cover 14 is positioned on a fan blade 22, the ring 82 hangs from the bottom side 78 of the blade cover 14, and thus the bottom side 64 of the fan blade 14.

Figure 7:
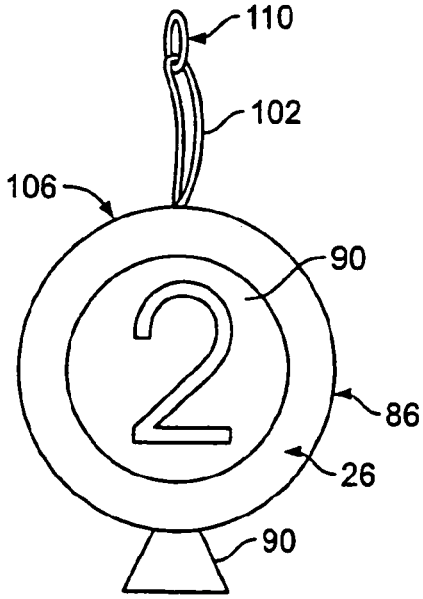
FIG. 7 illustrates an isometric view of an ornament according to an embodiment of the present invention.

FIG. 7 illustrates an isometric view of an ornament 26 according to an embodiment of the present invention. The ornament 26 shown in FIG. 7 is but one of any number of examples of what kinds of ornaments 26 may be used with the blade cover 14 (FIG. 6). The ornament 26 shown in FIG. 7 is made from fabric and is stuffed and sewn or stitched together along a peripheral region 86. The fabric of the ornament 26 may have any number of patterns, designs, colors, or styles. For example, the ornament 26 may have numbers, letters, shapes, or other representations sewn or displayed thereon. The ornament 26 has patches 90 of fabric sewn on sides thereof that may have any number of patterns, designs, colors, or styles. For example, the patches 90 may have numbers, letters, shapes, or other representations sewn or displayed thereon. The ornament 26 and the patches 90 may be made of a durable washable material, for example, the ornament 26 and patches 90 may be made of fabrics such as cotton, nylon, or any other synthetic or any blend of materials. Alternatively, any number of other attachments may be connected to the ornament 26 besides the patches 90. For example, strands or pieces of fabric having different shapes, colors or patterns may extend from the ornament 26.

Additionally, the ornament 26 may also be made of any number of other materials. For example, the ornament 26 may be made of plastic, rubber, metal, or synthetic materials. Additionally, the ornament 26 itself may be any number of shapes, colors, patterns, designs, or have any number of colors, patterns, designs, or representations displayed thereon. For example, a parent may wish to have a number of different ornaments 26 that each represents a letter of the alphabet, or a number, or an animal shape.

The ornament 26 includes a strand 102 of material that extends from a top end 106 thereof. The strand 102 may be connected to the top end 106 of the ornament 26 by any number of means, including, sewing, stitching, or gluing. Also, the strand 102 may be made of any number of materials and have any number of colors, patterns, or shapes. A clip 110 is connected to the strand 102. Alternatively, the clip 110 may be a ring, hook, clasp, prong, fastener or any number of other connecting features. Alternatively, the clip 110 may be connected directly to the ornament 26 without the need for the strand 102.

Returning to FIG. 1, in operation, the blade cover 14 is positioned on the fan blade 22 and secured thereto. The clip 110 of the ornament 26 is then connected to the ring 82 extending from the bottom side 78 of the blade cover 14 such that the ornament hangs, or is suspended from, the bottom side 78. As many different ornaments 26 and blade covers 14 as available fan blades 22 may be used. When all the desired number of fan blades 22 have been decorated with the blade covers 14 and ornaments 26, the fan 10 is activated such that the blade covers 14 and ornaments 26 rotate with the fan blades 22. A small child may be positioned in his or her crib or play pen beneath the fan 10 and observe the rotating blade covers 14 and ornaments 26. Depending on the themes and subjects parents may wish to present to their child, any number of different colors, shapes, patterns, designs, and representations may be displayed on the different ornaments 26 and blade covers 14.

Alternatively, the blade covers 14 and ornaments 26 may be used for decorations not directed specifically to the entertainment of children. For example, the blade covers 14 and ornaments 26 may have the colors, patterns, shapes, or bear the insignias, of sports teams. Thus, the blade covers 14 and ornaments 26 may be decorated and combined in any number of other ways suitable to the tastes of the person decorating the fan.

The different embodiments of the present invention provide several benefits. First, the fan can be left operating such that the ornaments and blade covers do not stop moving after only a short period of time. The constant movement of the ornaments and blade covers keeps the child distracted for a longer period of time and continues until the child falls asleep. Also, by suspending the ornaments high above the child on the ceiling fan, the child cannot reach them and disrupt the ornaments or blade covers. Additionally, parents may interchange any number of different ornaments with different blade covers to create a new and different kind of mobile for their child at any time. Therefore, parents are not limited to one particular theme, or pattern, or color that comes with a particular mobile, rather parents are free to create diverse visual presentations for their children.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A cover for a fan blade, comprising:

a sleeve having an open end for receiving said fan blade, said sleeve having hook and loop fasteners that are configured to engage each other to secure said sleeve about said fan blade;

an ornament; and connection features extending from said sleeve and said ornament, said connection features engaging each other to connect said ornament to said sleeve such that, as said fan blade rotates, said sleeve and ornament rotate therewith, wherein said sleeve has a bottom side and said ornament has a top end, one of said connection features extending from said bottom side of said sleeve and another of said connection features extending from said top end of said ornament, said connection features engaging each other such that said ornament is suspended from said bottom side of said sleeve.

2. The cover of claim 1, wherein said sleeve has a top side and said hook and loop fasteners are disposed proximate each other on said top side, said sleeve being folded about said top side such that one of said hook and loop fasteners is folded over, and engages, the other of said hook and loop fasteners.

3. The cover of claim 1, wherein said sleeve has a top side and said hook and loop fasteners are Velcro strips disposed along said top side, said top side of said sleeve being folded such that said Velcro strips engage each other to secure said sleeve about said fan blade.

4. The cover of claim 1, wherein said sleeve is fabric and has a rear end and side ends that are sewn together to form a passageway at an open end opposite a closed end, said open end receiving said fan blade into said passageway.

5. The cover of claim 1, wherein one of said connection features is a ring and the other of said connection features is a clip, said clip receiving said ring such that said ornament is suspended from said bottom side of said sleeve.

6. The cover of claim 1, wherein said ornament is made of fabric.

7. The cover of claim 1, wherein said sleeve is fabric and has a rear end and side ends that are sewn together to form a passageway at an open end, wherein said sleeve and fan blade each have a top side, said hook and loop fasteners being disposed on said top side of said sleeve, said sleeve receiving said fan blade in said passageway such that said top side of said sleeve is about said top side of said fan blade and said hook and loop fasteners are engaged at said top side of said sleeve to secure said sleeve to said fan blade.

8. The cover of claim 1, wherein said ornament has an enclosed strand extending therefrom that receives one of said connection features in order to connect said ornament to said connection feature.

9. A decorative mobile for use with an overhead fan blade, comprising:

a cover having closed rear and side ends to form a passageway at an open end opposite said rear end, said open end receiving said fan blade into said passageway, said cover having hook and loop fasteners that are configured to engage each other to secure said cover about said fan blade, said cover having a first connection feature extending therefrom; and an ornament having a second connection feature extending therefrom, said first and second connection features engaging each other to connect said ornament to said cover such that, as said fan blade rotates, said cover and ornament rotate therewith, wherein said cover has a bottom side and said ornament has a top end, said first connection features extending from said bottom side of said cover and said second connection features extending from said top end of said ornament, said connection features engaging each other such that said ornament is suspended from said bottom side of said cover.

10. The mobile of claim 9, wherein said cover has a top side and said hook and loop fasteners are disposed proximate each other on said top side, said cover being folded about said top side such that one of said hook and loop fasteners is folded over, and engages, the other of said hook and loop fasteners.

11. The mobile of claim 9, wherein said cover has a top side and said hook and loop fasteners are Velcro strips disposed along said top side, said top side of said cover being folded such that said Velcro strips engage each other to secure said cover about said fan blade.

12. The mobile of claim 9, wherein one of said first and second connection features is a ring and the other of said first and second connection features is a clip, said clip receiving said ring such that said ornament is suspended from said bottom side of said cover.

13. The mobile of claim 9, wherein said cover is made of fabric and said rear and side ends are sewn or stitched together.

14. The mobile of claim 9, wherein said cover and fan blade each have a top side, said hook and loop fasteners being disposed on said top side of said cover, said cover receiving said fan blade in said passageway such that said top side of said cover is about said top side of said fan blade and said hook and loop fasteners are engaged at said top side of said cover to secure said sleeve to said fan blade.

15. A decorative mobile for use with an overhead fan blade, comprising:

a cover having closed rear and side ends to form a passageway at an open end opposite said rear end, said open end receiving said fan blade into said passageway, said cover having a top side and hook and loop fasteners that are disposed proximate each other on said top side, said cover being folded about said top side such that one of said hook and loop fasteners is folded over, and engages, the other of said hook and loop fasteners to secure said cover to said fan blade, said cover having a first connection feature extending therefrom; and an ornament having a second connection feature extending therefrom, said first and second connection features engaging each other to connect said ornament to said cover such that, as said fan blade rotates, said cover and ornament rotate therewith.

16. The mobile of claim 15, wherein said hook and loop fasteners are Velcro strips disposed along said top side, said top side of said cover being folded such that said Velcro strips engage each other to secure said cover about said fan blade.

17. The mobile of claim 15, wherein said cover has a bottom side and said ornament has a top end, said first connection feature extending from said bottom side of said cover and said second connection features extending from said top end of said ornament, said connection features engaging each other such that said ornament is suspended from said bottom side of said cover.

18. The mobile of claim 15, wherein one of said first and second connection features is a ring and the other of said first and second connection features is a clip, said clip receiving said ring such that said ornament is suspended from said bottom side of said cover.

* * * * *